United States Patent [19]

Alquist

[11] Patent Number: 5,009,353

[45] Date of Patent: Apr. 23, 1991

[54] CABLE TENSIONING DEVICE

[75] Inventor: John W. Alquist, Quinnesec, Mich.

[73] Assignee: Lake Shore, Inc., Kingsford, Mich.

[21] Appl. No.: 473,617

[22] Filed: Feb. 1, 1990

[51] Int. Cl.[5] ..... B65H 77/00; B66D 1/00

[52] U.S. Cl. ..... 226/172; 242/157.1; 254/265; 254/266

[58] Field of Search ..... 226/172; 474/100, 111, 474/136; 254/268, 265, 335, 336, 338, 371, 266; 242/157.1

[56] References Cited

U.S. PATENT DOCUMENTS

| | | | |
|---|---|---|---|
| 2,480,488 | 8/1949 | MacClatchie | 242/157.1 X |
| 2,647,699 | 8/1953 | Bush | 242/54 |
| 2,660,382 | 11/1953 | Wilson | 242/157.1 X |
| 2,738,143 | 3/1956 | Hannay | 242/157.1 |
| 2,855,163 | 10/1958 | Powers | 242/157.1 |
| 3,881,647 | 5/1975 | Wolfe | 226/172 |
| 4,469,267 | 9/1984 | Franchuk et al. | 226/172 |
| 4,848,697 | 7/1989 | Skalleberg | 242/157.1 X |

FOREIGN PATENT DOCUMENTS

| | | |
|---|---|---|
| 0596107 | 4/1960 | Canada . |
| 0664911 | 5/1979 | U.S.S.R. . |

*Primary Examiner*—Lenard A. Footland
*Assistant Examiner*—Paul Bowen
*Attorney, Agent, or Firm*—Michael, Best & Friedrich

[57] ABSTRACT

The cable tensioner has a pair of elongated platforms mounted side-by-side on a base with each having drive and driven geared pulleys with geared idler pulleys therebetween arranged along the edge of the platform confronting the other platform. A geared endless belt encircles the pulleys on each platform and has a grooved exterior machined to match the cable being handled. The drive and driven pulleys are adjusted to tension the associated belts and the idler pulleys are pressed towards the idlers on the adjacent platform. The base is mounted to permit sideways motion plus pivoting, tilting and rising and falling as a unit.

8 Claims, 4 Drawing Sheets

CABLE TENSIONING DEVICE

BACKGROUND OF THE INVENTION

For proper spooling of a cable on a winch drum, it is necessary to keep a certain amount of tension on the cable for a neat, tight spool. When paying out cable from a drum it is necessary to keep tension on the line to prevent what is commonly called "birdcaging". This occurs when the winch drum pays out line faster than the line is retrieved or taken up.

One type of cable tensioner generally has one driven sheave and one or two idler sheaves with one or more pinch rollers to force the wire rope down into the sheave grooves causing a wedging action on the cable. To obtain the necessary friction area to lower the pounds per square inch force it is necessary to have an "S" curve cable lead to obtain the friction area required. These tensioners are required to handle the full line pull of the winch drum and must have sheave diameters proportionally larger than the cable diameter to avoid excessive bending of the cable.

Another type of tensioner presently utilized has compressible floating sides to the friction sheave along with a pinch roller to provide the necessary friction. Again it is necessary to have an "S" curve in the cable in the tensioner plus again having to handle the full winch load with the necessary large sheaves.

The two types described above cause constant bending, flexing and pinching of the wire rope causing premature failure of the cable.

Still another type of tensioner simply has the wire rope pinched in between two sheaves. In order to develop any appreciable amount of line pull it is necessary to place considerable pressure on the cable which then also results in premature cable failure.

Attention is directed to U.S. Pat. Nos. 4,469,267 and 2,647,699.

An object of this invention is to provide a cable tensioner which will maintain a constant tension on a cable without any bending, flexing or pinching of the cable.

Another object is to provide a tensioner which will follow the cable lead which means the structure does not change the direction of the cable lead (and load). It only has to support its own weight and some of the weight of the cable between the drum and the guide pulley. The tensioner must also handle the line pull under some conditions.

SUMMARY OF THE INVENTION

This invention provides a pair of elongated platforms mounted side-by-side on a base to pivot, tilt and rise and fall as a unit while also, optionally, sliding from side-to-side as a unit. On each platform an endless belt encircles a drive pulley at one end of the platform, a driven pulley at the other end and a series of idler pulleys arranged in a line between the drive and driven pulleys along one side of the platform adjacent the other platform. The belts have a grooved exterior machined to match the size of the cable being handled and the inside of the belts is provided with gear teeth. The pulleys are all provided with gear teeth. A cable has a straight run between the belts and the platforms are adjusted towards each other to impose a lateral load on the pulleys and belts and the cable. The belts are shaped to receive and grip the cable as the belts are squeezed onto the cable and the belts positively engage the pulleys, thus maximizing the drive and braking.

DETAILED DESCRIPTION OF THE DRAWINGS

Figure 3:
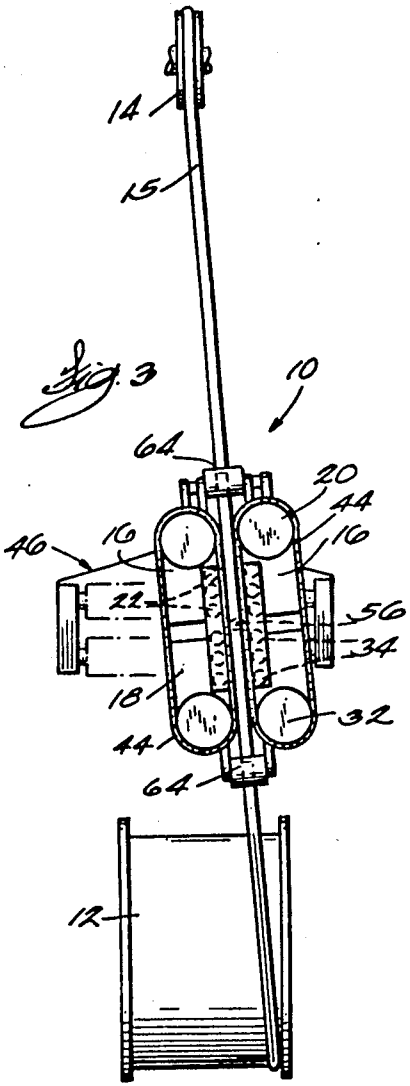
FIGS. 1-3 are schematic plan views of the tensioning device positioned between a guide sheave and a winding drum
Figure 2:
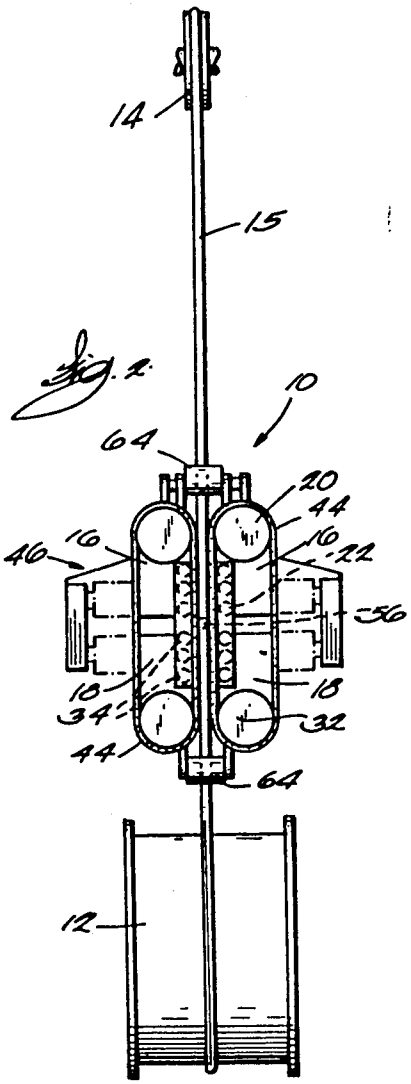
Figure 1:
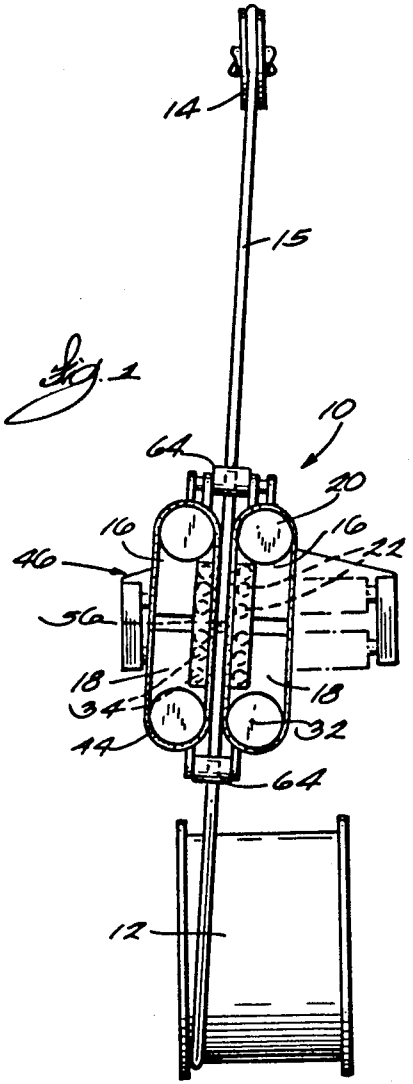
Figure 4:
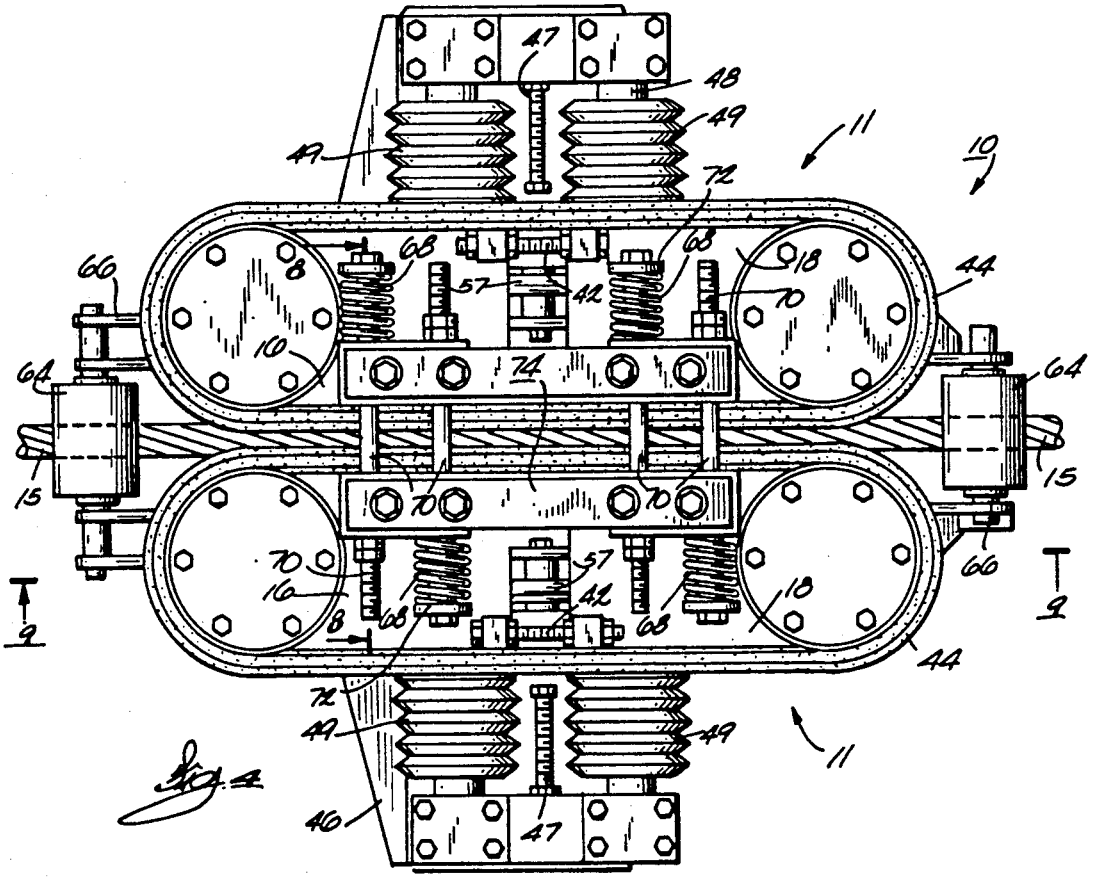
FIG. 4 is a plan view of the tensioner.
Figure 5:
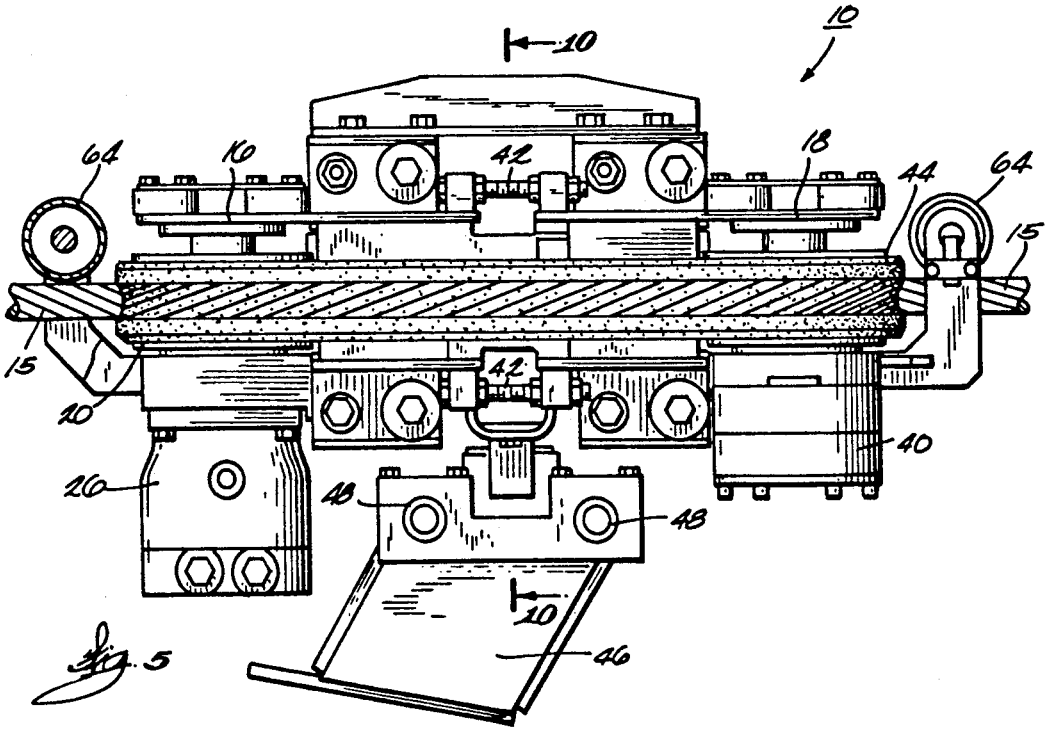
FIG. 5 is a side elevation of the tensioner.
Figure 6:
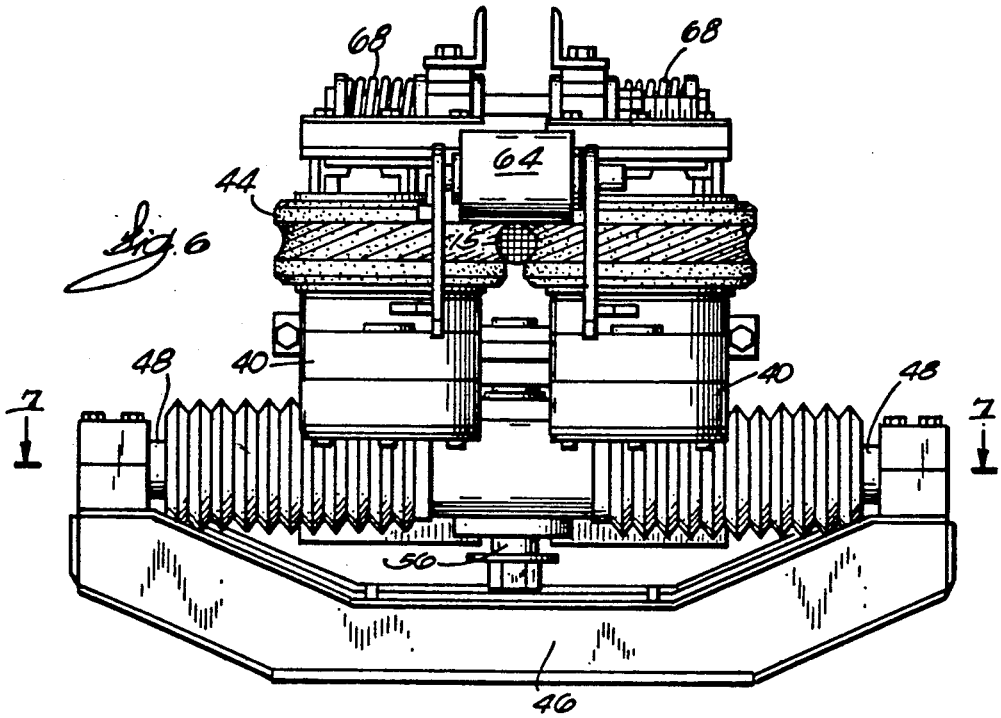
FIG. 6 is an end view of the tensioner.
Figure 7:
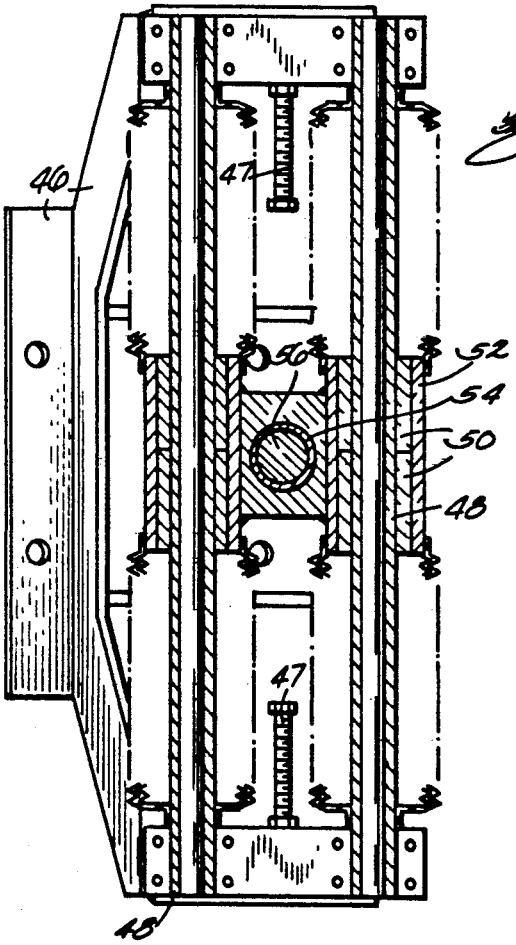
FIG. 7 is a horizontal section taken down the center of FIG. 6.
Figure 8:
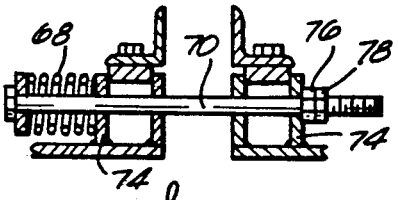
FIG. 8 is a detail of the spring load adjustment.
Figure 9:
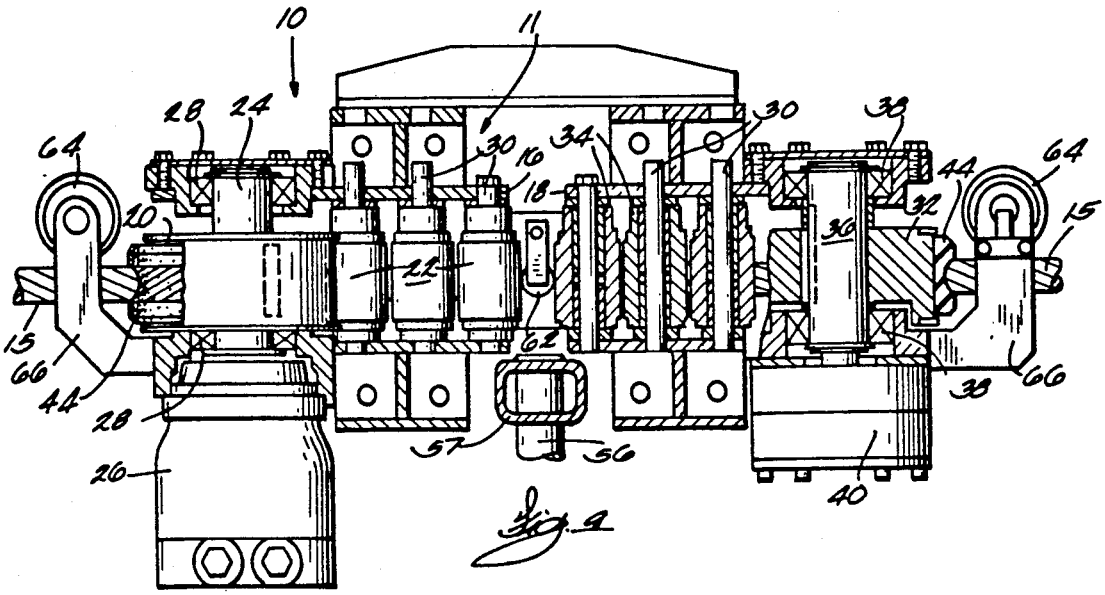
FIG. 9 is a section taken in line 9-9 in FIG. 4.
Figure 10:
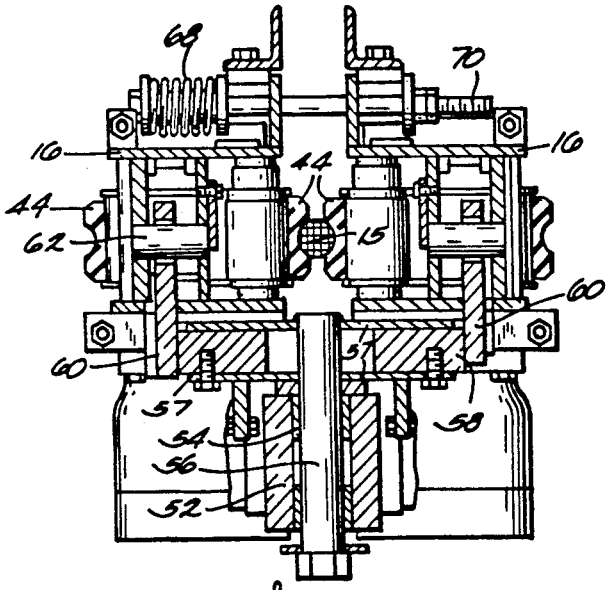
FIG. 10 is a vertical section on line 10-10 in FIG. 5.

The cable tension device 10 is mounted on a base 46 between the cable drum 12 and a forward guide sheave at 14. Cable 15 runs through the tension device 10. The device 10 is made up of two elongated housings or platforms 11 each of which is comprised of front and rear halves or plates 16 and 18. The forward half 16 of either platform 11 contains the gear toothed drive pulley 20 and three gear toothed idler pulleys 22. The drive pulley 20 is keyed to the shaft 24 of hydraulic motor 26 fixed on plate 16. Shaft 24 is supported by two anti-friction bearings 28. The three idler pulleys 22 are supported by oil impregnated bushings on fixed shafts 30.

Each rear housing half or plate 18 contains a gear toothed driven pulley 32 and three gear toothed idler pulleys 34. The driven pulley 32 is keyed to the brake shaft 36 which is supported by two anti-friction bearings 38 and is operated by hydraulic brake 40. The idler pulleys 34 are supported by oil impregnated bushings on fixed shafts 30.

The forward and rear plates 16, 18 are held in line with each other by a machined fabricated male "key" on the forward plate 16 and mating female surfaces on the rear plate 18. Two adjusting bolts 42 allow for adjusting the center distance between the drive and driven pulleys to allow mounting and adjustment of an endless belt 44 on the drive pulley 20, driven pulley 32 and idler pulleys 22,34. The belt has teeth on its inside surface to engage gear teeth on the pulleys. Molded to the outside of the belt is a layer of high friction (with grit) polyurethane with a groove machined to match the cable being used The gearbelt groove configuration, material and durometer (77-83, Shore A) was determined after exhaustive testing on various types of materials and grooving. The forward and rear plates 16, 18 are pushed towards each other to install the belt 44 and then adjusted outward (apart) by bolts 42 to provide the proper tension on the belt. Depending on the use and type of cable the characteristics of the belt may change. It should not be so soft as to collapse under load nor so hard as to skid on the cable.

Each hydraulic motor 26 is of the high torque, low speed type. The hydraulic brakes 40 are spring set and hydraulically released. The cable tensioner 10 may be furnished with or without brakes as required by various applications.

In lieu of hydraulic motors and brakes the cable tension device 10 may be electric motor driven through a suitable torque increaser along with electrically released brakes. Electric controls and load sensing components may be added as required.

The base 46 supports two horizontal hardened steel shafts 48 upon which linear bushings 50 enclosed in slide housing 52 ride. This is the supporting structure for the cable tension device 10. The entire tensioner 10 can move sideways on shafts 48 which are fixed in base 46 with bellows 49 protecting the shafts from dirt. Stop bolts 47 thread into the base 46 and are adjusted to limit such sideways movement of the tensioner upon engagement of housing 52 with the bolt.

The center of the slide housing 52 contains oil impregnated bushings 54 into which a vertical yoke shaft 56 fits. The yoke shaft 56 is free to rotate and also may lift vertically.

The yoke 57 is made in three parts: The center part 58 with the shaft 56 and two yoke ends 60. Each yoke end 60 contains an oil impregnated bushing into which pin 62; attached to the forward plate 16, is inserted. These pins 62 support the right and left hand forward plates 16 and also allow for the tilt motion about the axis of pins 62.

A cable roller 64 with oil impregnated bushings is mounted by a bracket 66 at each end of the platform assemblies. The cable 15 rides underneath these rollers and as the cable lead varies up or down the cable 15 lifts or lowers the platform assemblies on yoke shaft 56 to keep the grooved gearbelts 44 in line with the cable between drum 12 and guide pulley 14.

The housings can move closer together or apart along pins 62, thus making it possible to adjust the loading on the cable 15 and, therefore, the grip of the belts on the cable. To provide the loading, four springs 68 above the platforms and four similar springs below act to press the platforms towards each other to provide the compression of the grooved gearbelts 44 onto the cable 15. Each spring 68 is fully adjustable via a bolt 70 which extends between the left and right hand platforms with the washer 72 capturing the spring 68 between the washer and bracket 74 while the bolt extends through bracket 74 on the opposite platform. The nuts 76, 78 adjust the compression of the springs and the spacing of the platforms and the drive, driven and idler pulleys. The adjustment of the springs depends on the line pull desired on the cable tensioner.

The spring set, hydraulically released brakes 40 maintain a preset, constant line pull between the tensioner and the winch drum upon loss of hydraulic power. The adjustable springs 68 mechanically maintain constant compression on cable 15 between the two polyurethane gearbelts. The outside circumference of each gearbelt is grooved to receive and have a form fit on cable 15 to provide the friction necessary for the line pull. Cable 15 runs between these two gearbelts. The inside circumference of each gearbelt has nylon faced teeth which engage the drive and driven pulleys which are spaced so that a series of small idler pulleys 22, 34 may be placed between them to give a straight flat surface to provide a large friction area without any bending of the cable.

Each of the two independent platforms 11 supports a gearbelt, motor, brake, a driver pulley, driven pulley, and multiple idler pulleys. Each platform 11 is mounted on a yoke 57 which slides from side to side on linear bushings supported by two hardened shafts 48. The housings 11 will also pivot, tilt and raise or lower to follow the cable lead. More precisely, the cable 15 moves the cable tension device 10 to align with the cable. This puts no strain or load on the cable or cable tension device other than the cable tension produced by the cable tension device.

Because of the large straight friction area of the gearbelts a low load (pounds per square inch) is imposed on the cable which results in a long cable life. Since this tensioner imposes only a small load on the cable, electrical cable may be used and may be hauled in or payed out without damage to the wire in the cable.

The cable tension device may be supplied with small hydraulic cylinders to maintain the compression on the cable between the two gearbelts in lieu of compression springs.

The cable tension device may also be used for applications where it is not necessary to have lateral sliding base function. The yoke pin, in those cases, would be fixed on a solid mounting plate. The cable tension device would still have the pivot and tilt motions. The cable tension device is capable of performing its function but at a reduced load rating even if one motor and brake were to fail.

The motors are bi-directional and can haul in or pay out cable. The brakes can be applied during either operation or when idle.

The cable tension device may be used to keep constant tension on a cable to a tow or on the cable to the winch drum, to keep a tight spool on a winch drum, or to keep constant tension on a cable during equipment "down time". It may be used to pay out cable from a freely rotating drum or reel, or to haul in cable to a take up drum or reel, or to simply move a heavy cable (i.e. used as a small capstan without requiring wraps on a drum or capstan). It may also be used with electrical cable for any of the above reasons.

As cable is wound on the drum 12, the diameter increases and this will cause the tensioner to rise to keep in line with the cable between the drum and the sheave 14. As the cable wraps between the sides of the drum the tensioner will slide from side-to-side on rails 48 to stay in line. The tilting action allows the tensioner to accommodate changes in drum diameter causing a change in slope of the cable between the drum and the sheave. The pivot action occurs in combination with the sliding action. Thus, the tensioner always allows the cable to assume its mort direction (straight) line from the drum to the sheave.

I claim:

1. A cable tensioner comprising, a base, a pair of generally horizontal elongated platforms mounted side-by-side on said base, a drive pulley at one end of each platform, a driven pulley at the other end of each platform, a multiplicity of idler pulleys mounted in a line along the edge of each platform adjacent the other platform, an endless belt having a grooved exterior and gear teeth on its interior and encircling the drive, driven and idler pulleys of each platform whereby the belts on said platforms have a generally horizontal long straight run between them to receive a cable therebetween in the grooved exterior, a motor connected to each said drive pulley, a brake connected to each said driven pulley, a means for adjusting the spacing between said platforms to adjust the force with which said belts grip a cable in said straight run, means enabling said platforms to tilt as a unit about a generally horizontal axis transverse said elongated platforms, means enabling said platforms to pivot in a generally horizontal plane as a unit about a generally vertical axis, means enabling said platforms to rise or fall as a unit relative to said base, and slide means between said base and said platforms permitting said platforms to move laterally of said platforms in a generally horizontal plane, said motors and said brakes being energized as required to provide desired tension on the cable leading either direction from the tensioner.

2. A cable tensioner according to claim 1 including means for adjusting the tension of each of said belts.

3. A cable tensioner according to claim 2 in which said pulleys have teeth engaging said teeth on the inside of said belts.

4. A cable tensioner according to claim 3 including a pulley at each end of the tensioner above the path of a cable running through said straight run.

5. A cable tensioner according to claim 4 in which each motor connected to each of said drive pulleys is a hydraulic motor.

6. A cable tensioner according to claim 5 in which said brake is a hydraulic brake.

7. A cable tensioner comprising, a base, a pair of elongated platforms mounted side-by-side on said base, a geared drive pulley at one end of each platform, a geared driven pulley at the other end of each platform, a multiplicity of geared idler pulleys mounted in a line along the edge of each platform adjacent the other platform, an endless geared belt having a grooved exterior and encircling the drive, driven and idler pulleys of each platform whereby the belts on said platforms have a generally horizontal long straight run between them to receive a cable therebetween in said grooved exterior, a motor connected to each said drive pulley, means urging said idler pulleys on one platform towards those on the other platform, means for adjusting the force with which said idler pulleys on each platform are urged towards the idler pulleys on the other platform to thereby determine the force with which said belts grip a cable in said straight run, means enabling said platforms to tilt as a unit about a generally horizontal axis transverse said elongated platforms, and means enabling said platforms to pivot as a unit in a generally horizontal plane about a generally vertical axis, said motors being operated to provide desired tension on the cable to the winch or to the load.

8. A cable tensioner according to claim 7 including means for adjusting the tension of each of said belts.

* * * * *